US007396496B2

(12) United States Patent
Bull

(10) Patent No.: US 7,396,496 B2
(45) Date of Patent: Jul. 8, 2008

(54) REINFORCEMENT ELEMENT AND METHOD OF PRODUCING A REINFORCEMENT ELEMENT

(75) Inventor: Anders Henrik Bull, Asker (NO)

(73) Assignee: BBA Blackbull AS, Nesbru (NO)

( * ) Notice: Subject to any disclaimer, the term of this patent is extended or adjusted under 35 U.S.C. 154(b) by 0 days.

(21) Appl. No.: 10/489,966

(22) PCT Filed: Sep. 16, 2002

(86) PCT No.: PCT/NO02/00324

§ 371 (c)(1),
(2), (4) Date: Sep. 22, 2004

(87) PCT Pub. No.: WO03/025305

PCT Pub. Date: Mar. 27, 2003

(65) Prior Publication Data

US 2005/0064184 A1 Mar. 24, 2005

(30) Foreign Application Priority Data

Sep. 20, 2001 (NO) ..... 20014582

(51) Int. Cl.
*B29C 70/52* (2006.01)

(52) U.S. Cl. ..... 264/103; 264/131; 264/136; 264/137; 264/236

(58) Field of Classification Search ..... 428/370, 428/371, 375, 372; 264/103, 136, 137, 131, 264/236; 52/740.1; 106/99; 427/407.1
See application file for complete search history.

(56) References Cited

U.S. PATENT DOCUMENTS

| | | | | |
|---|---|---|---|---|
| 4,915,739 | A * | 4/1990 | Sawanobori et al. | 524/5 |
| 4,916,012 | A * | 4/1990 | Sawanobori et al. | 428/367 |
| 5,030,282 | A * | 7/1991 | Matsuhashi et al. | 106/692 |
| 5,114,653 | A * | 5/1992 | Schuerhoff et al. | 264/228 |
| 5,368,934 | A * | 11/1994 | Torii et al. | 428/372 |
| 6,187,434 | B1 * | 2/2001 | Arai et al. | 428/367 |
| 6,200,678 | B1 * | 3/2001 | Hunt et al. | 428/371 |
| 6,270,714 | B1 * | 8/2001 | Azran et al. | 264/443 |
| 6,743,832 | B2 * | 6/2004 | Van Dijk et al. | 523/137 |
| 6,838,123 | B2 * | 1/2005 | Staheli | 427/459 |
| 6,875,509 | B2 * | 4/2005 | Ando | 428/375 |

FOREIGN PATENT DOCUMENTS

| | | |
|---|---|---|
| WO | WO 96/02715 | 2/1996 |
| WO | WO03/025305 A1 * | 3/2003 |

* cited by examiner

*Primary Examiner*—Leo B Tentoni
(74) *Attorney, Agent, or Firm*—Young & Thompson

(57) ABSTRACT

Procedure for fabrication of reinforcement elements for concrete, where an extended, preferably continuously fiber bundle (10), especially of carbon fibers, impregnates (3) by a matrix of a plastic material followed by curing. The fiber bundle (10), including a significant amount of single fibers, is brought after impregnation (3) and prior to curing (17) to cooperate with a particle shaped material (15), preferably sand, as adhere to the fiber bundle surface mainly without coming in between the fibers and fixate to the surface by curing, for creation of a reinforcement element.

18 Claims, 9 Drawing Sheets

Fig.. 5

REINFORCEMENT ELEMENT AND METHOD OF PRODUCING A REINFORCEMENT ELEMENT

BACKGROUND OF THE INVENTION

This invention states a reinforcement element for concrete and a method how to fabricate such a reinforcement element. The element is of the kind that includes an extended, preferably continuously bundle of fibres, especially carbon fibres, impregnated, witch a plastic based matrix wish is cured.

DESCRIPTION OF THE RELATED ART

Use of traditional reinforcement of concrete, it is known to use steel rebar with profiled surface with the intention to increase the bond towards the concrete as example a ribbed bar. Such ribbed reinforcement bars can also be used as mesh and other reinforcing structures depending on what shall be produced or build in reinforced concrete. It is also known to use reinforcement elements or mesh based on non-metallic materials, especially elements based on fibres, also including carbon fibres. Also this type of reinforcement elements has been subjected for ribbed or similar surface treatment with the intention to ensure a proper adhesion when embedded in concrete.

Example on previous known executions can be found in U.S. Pat. No. 5,362,542 and U.S. Pat No. 6,060,163 and Japanese patent publications 020, 484,45A, 040, 596, 42A, 031, 502, 41A, 031, 502, 42A, 032,958,38A, 020,484,44A, 021,924,44A, 030,838,40A, and 010, 189, 50A.

SUMMARY OF THE INVENTION

In the light of the known technology, the present invention takes the starting point in a method where an extended preferably continuous bundle of fibres, especially carbon fibres, impregnates with a matrix based on a plastic material followed by curing.

The invention does it possible to achieve a better performance of reinforcement materials or mesh where the surface structure gives a very favourable foundation and adhesion in concrete being caste around, in addition as the fabrication of such elements can take place in a simple and effective manner to low cost. This to be achieved by assistance of the new and characteristic feature in accordance to the invention, as described in the patent claims.

BRIEF DESCRIPTION OF THE DRAWINGS

The invention shall in the following be explained closer by referring to the drawings, where.

DESCRIPTION OF THE PREFERRED EMBODIMENTS

Figure 1:
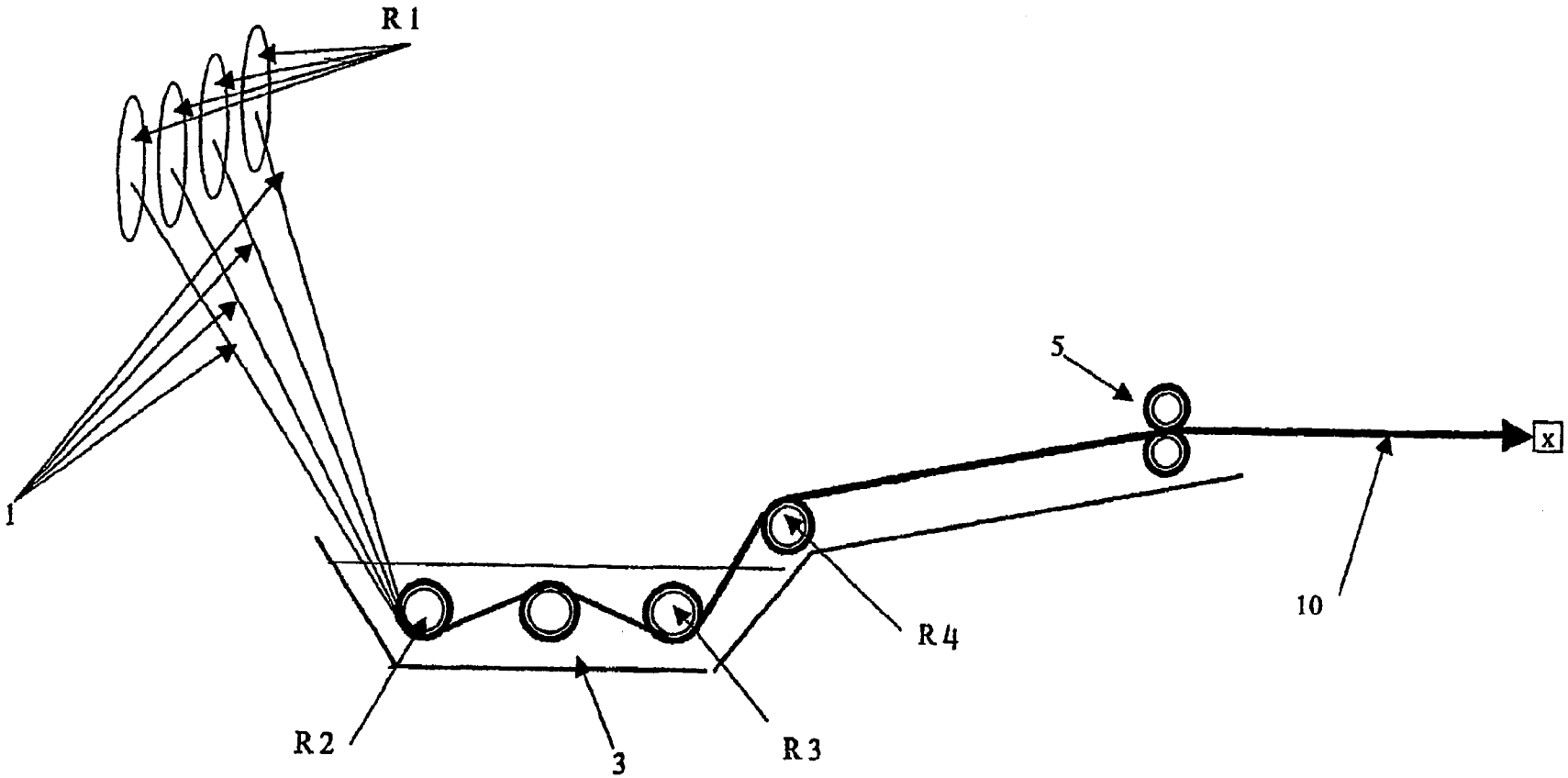
FIG. 1 schematic show the first step in the production of a fibre bundle with impregnation of a plastic material, FIG. 2 likewise show the first step in accordance to the invention, for treatment of the fibre bundle from FIG. 1, to a more or less finished product in form of a treated reinforcement element, FIG. 3 show an alternative performance compared to the one in FIG. 2, namely for production of a continuously and flexible reinforcement element, as example as a band, FIG. 4 show another alternative performance, where the reinforcement element is utilized to fabricate a dedicated reinforcement structure, as example with focus to pillar reinforcement, angular reinforcement or similar, FIG. 5 show very elevated an example on a cross section of a fibre bundle and a coated reinforcement element in accordance to the invention.

In the first part of the fabrication line, as illustrated on FIG. 1, a large number of continuous single fibres or filaments 1 are pulled or supplied in a large number from the same amount of stock or spools R1 and brought together down in a container with a bath of liquid plastic material or matrix 3 for impregnation. The gathered fibre bundle is lead into the bath 3 by assistance from rollers, as example marked R2 and R3. Over the roller R4 the impregnated fibre bundle is guided out of the bath, possibly by giving a pretension, which can take place by assistance from a pulling device 5 including double rollers, also acting to press out additional uncured plastic materials the fibre bundle is impregnated with. From there, the fibre bundle 10 is guided further to the following fabrication steps, with focus on fabrication of a continuous pole type reinforcement element, possibly a flexible band or equal or reinforcement mesh, respectively a tree dimensional reinforcement structure. Also twinning of the fibre bundle can be of interest.

In conjunction to FIG. 1, it shall be pinpointed that the invention assume a significant number of single fibres 1 in the compound fibre bundle 10, where the number of figures shall be in the magnitude of 1000 or may be up to 10,000,000 or more. In practice this is total realistic because the fibre diameter typical can be 7 microns. In the bath 3 the liquid plastic is thermo set or eventually thermo plastic. Examples for suitable plastic materials are polyester, vinyl ester, and epoxy materials. When the fibres or filaments 1 are impregnated for following composite association with each other, the high number of single fibres will have great importance. The increasing number of fibres and increasing fibre bundle dimension, the relative surface towards the surrounding environment is reduced. The surplus of the matrix or plastic material being applied, as partly will remain adhered on the outside of the fibre bundle, can vary depending on different temperatures and viscosities of the plastic material. Here a significant amount of variation possibilities is present with focus how to decide the required amount of plastic cover outside the composite fibre bundle, minding the required properties, as adhesion or shear capacities after embedded in concrete. When it comes to viscosity (after Brookfield, test in accordance to ASTM D 2196-86), this may be in the range of 100-1000 mPas (cP), which mainly will cover the actual alternative matrix materials .

In the following fabrication steps as illustrated on FIG. 2 (and FIG. 3) the impregnated fibre bundle 10, while the impregnation material still is mostly uncured and near the liquid phase, is guided to cooperation with a particle shaped material 15 located in boxy type container 12. In the bottom of the box 12 there are organized nozzles or holes 13 as appropriate with its cross section form gives the fibre bundle requested cross section profile. When the fibre bundle 10 from the holes 13 pass through the reservoir of particle shaped material 15, as in accordance to the invention primarily is sand, the particles will adhere to the surface of the fibre bundle, and then be permanent rooted or fixated to the surface of the fibre bundle by curing in zone 17. By assistance from a pulling device with rollers 18 the finished reinforcement element brought to a cutting and packing station not illustrated in FIG. 2. There is an essential feature with the fabrication as illustrated on FIG. 2, that the particle shaped material such as sand, adhere to the surface of the fibre bundle 10 mainly without coming in between the fibres. This is a great benefit because potential sharp particles potentially could penetrate in the cross section of the fibre bundle in between the single fibres, will potentially damage the fibres in this fabrication stage or potentially under following static or dynamic forces as the fibres will suffer, as in a cured reinforced concrete. As an example on cross section geometries that the hole 13 can give the fibre bundle 10, a circular or rectangular shape is nearby, but it is clear that cross section geometries can freely be chosen depending on the use for the reinforcement element.

Figure 2:
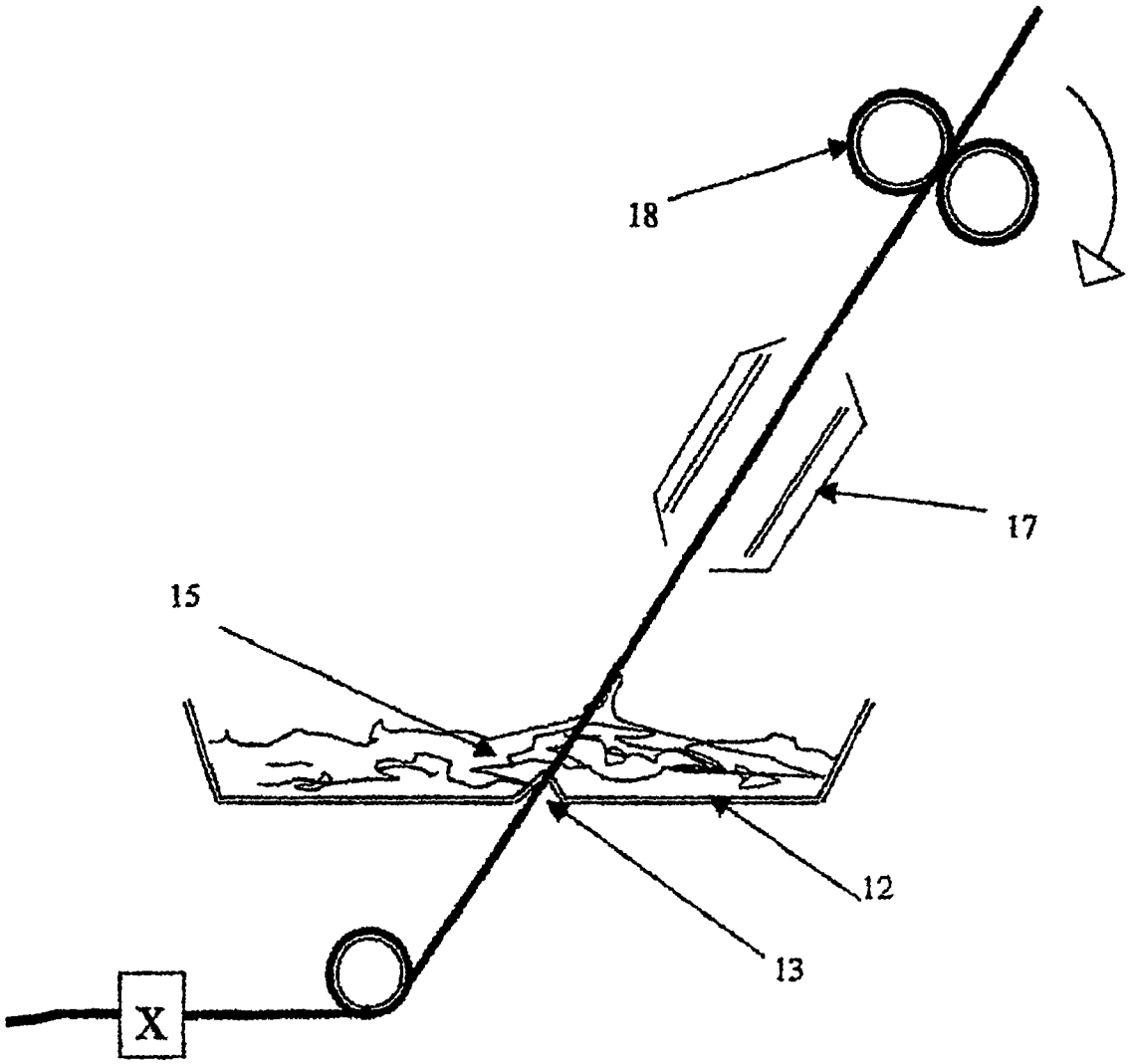

In conjunction for the above mentioned parameters in the fabrication steps in accordance to FIG. 1 and FIG. 2, it calls here that a fabrication temperature or curing temperature in the zone or device 17, can be in the range of 15-40° C., based on the most common curing systems. This is also with the thought for a potential manual placing or handling for fabrication of special reinforcement structures at later fabrication steps.

By use of sand as particle shaped material the grade can appropriate be in the range of 100 microns to 5000 microns particle diameter. Together with the previous parameters for the matrix material and so on, such sand will give an advantages adhesion to or shear capacity between the fibre bundle and the surrounding caste concrete. This allows an optimal utilization of the special fabricated composite fibre bundle. For use in concrete optimal shear capacity is 1-50 Mpa.

Figure 3:
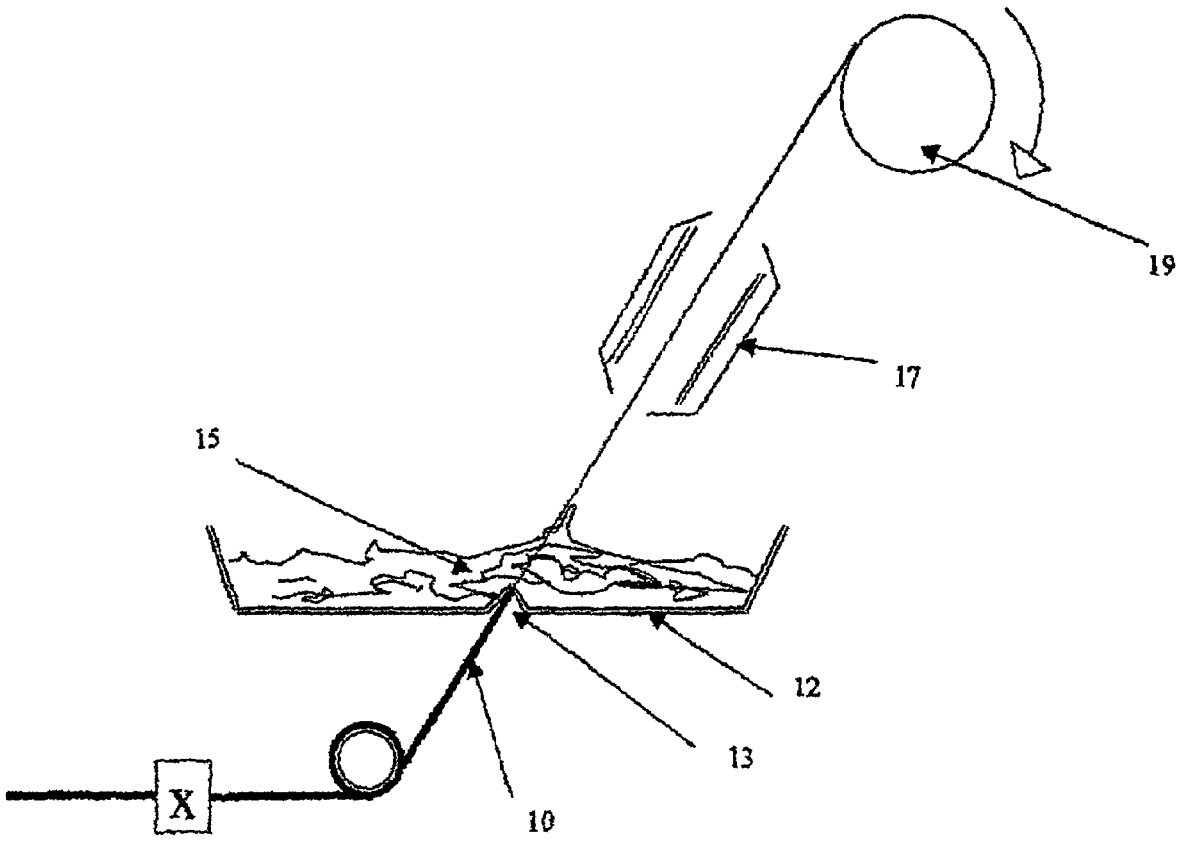

The fabrication steps in accordance to FIG. 3 segregates from the execution in accordance to FIG. 2 by that the finished reinforcement element winds up as a coil on a drum 19 also acting as a pulling device to pull the reinforcement element through the curing device 17 and to store the finished product, as in this case presuming to have sufficient flexibility or bend ability, achieved by suitable choice of the mentioned parameters and materials as entering in the fabrication.

Figure 4:
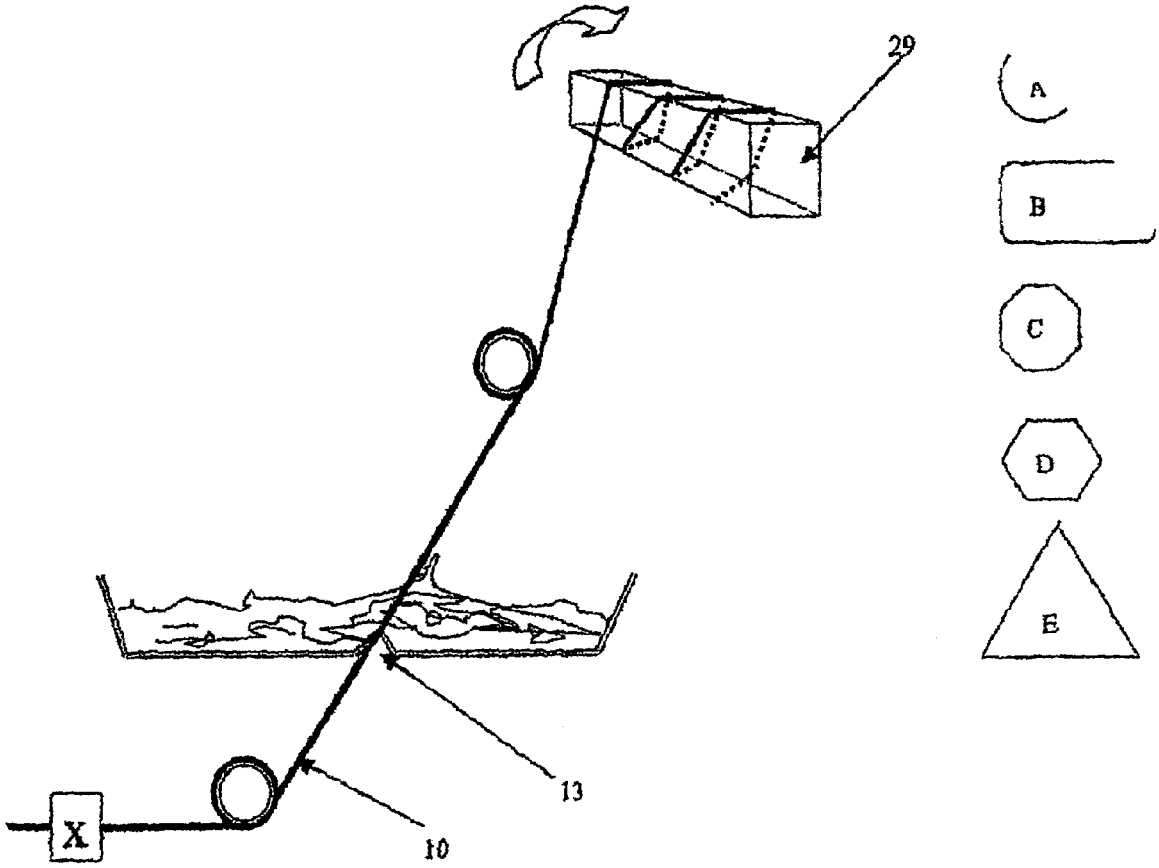

The arrangement in FIG. 4 have the most steps like the illustration on FIGS. 2 and 3, but here it is arranged a rotateable mould body 29 as the reinforcement material winds up on under the continues fabrication process. First of all the body 29 also serves pulling the reinforcement element from the previous fabrication step, and secondly the cross section of the body 29 and the guides of the reinforcement materials on this is adjusted so that the desired configuration is achieved. As an example, this can be a prefabricated reinforcement structure for a concrete pillars. It can be imagined a large number of variations such as cross section geometry of the mould body 29, with focus on decided cross section or configuration of the reinforcement. Some of the cross section variations are shown on FIG. 4 by A, B, C, D and E.

Figure 5:
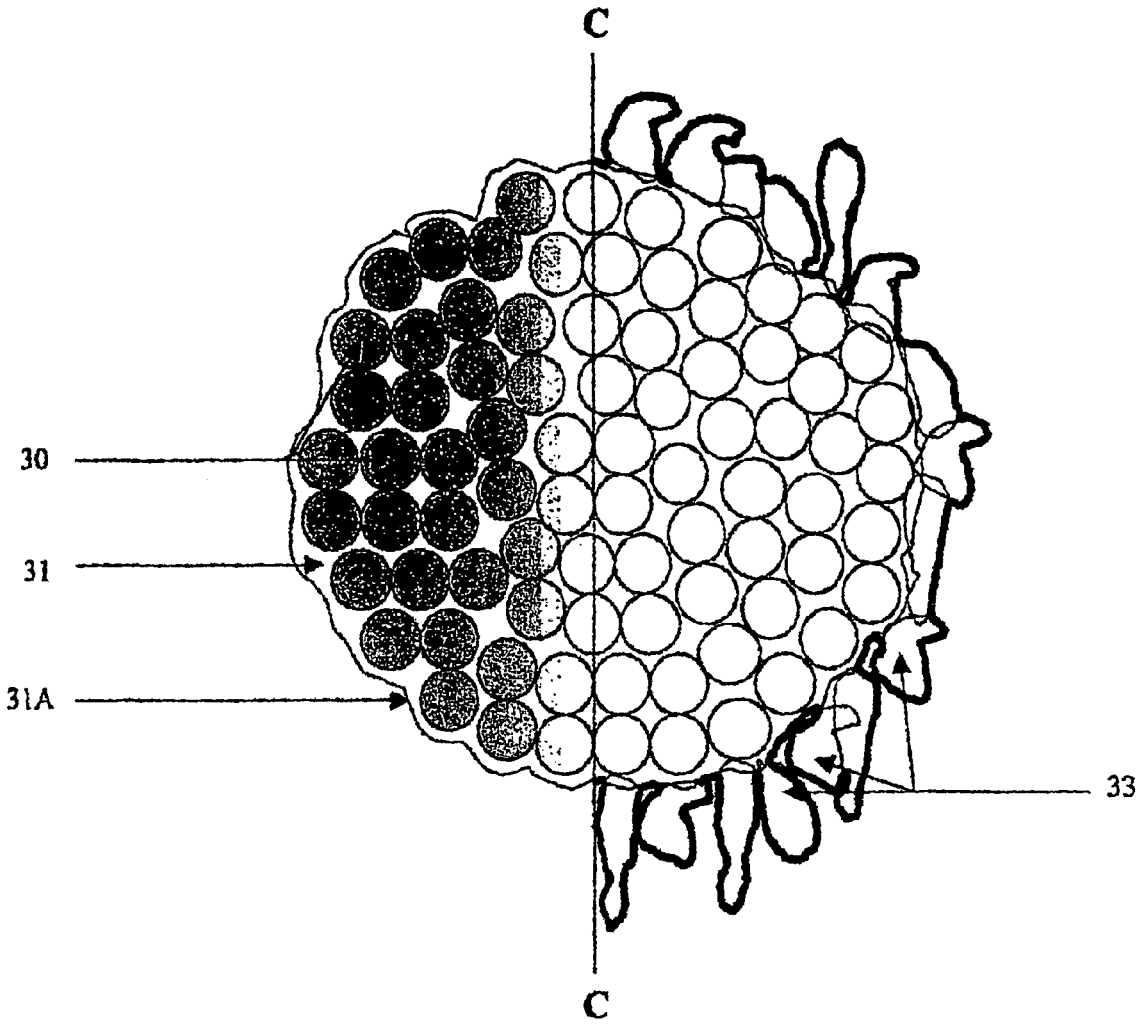

A fibre bundle is shown as a cross section and strongly elevated at FIG. 5. The left halve of this figure shows a fibre bundle of filaments 30 where the impregnation material or matrix is applied, where the plastic material has penetrated in to the fibre bundle cross section and filled the voids in between the single fibres 30, and the outer surface 31A mainly constitute this coating of the plastic material. This condition as illustrated on the left side of FIG. 5 correspond to the fabrication step ahead of applying of the particles, for example in form of sand, the cross section will be as shown on the right side of FIG. 5. The shown particles 33 can have wide range of shapes and sizes, but as illustrated on FIG. 5 the particles can be considered to be drawn some decreased compared to the dimensions of the fibre bundle inside. Furthermore it is clear that the previous described curing of the reinforcement element result in a fixed foundation of the particles 33 in the surface layer 31A of the curable plastic material 31. For fabrication of reinforcement elements as reinforcement mesh or equal it is in accordance to the invention suggested performance as first of all schematic is illustrated on FIG. 6. There it is shown a under layer surface or support 20 with the requested horizontal extent, for example with a couple metres side edge in a rectangular form adjusted to what kind of construction to be reinforced, such as a slab in a building. Along the edge of a supporting surface 20 it is shown a lot of guidance elements 1-8 as for example sticks or a spike organized in a predicted manner. It is also possible to organize (not shown) edge-or wall segments some elevated, compared to the supporting surface 20 along the edges, however not as elevated as the guiding elements 1-8.

Based on an organization just described, a mesh geometry reinforcement geometry be fabricated by that a fibre 10, coming from the previous fabrication step in accordance to FIG. 1, be guided mechanically or manually between the guiding elements 1-8 for creation of a mesh for example with small rectangular meshes. This takes place while the impregnation of the fibre bundle still is not cured. The winding or guidance of the reinforcement element 10 can take place multiple or in several turns, so that it more or less layer on layer creates a reinforcement grid with a dedicated thickness of the individual straight parts of the fibre bundle creating the mesh.

Figure 6:
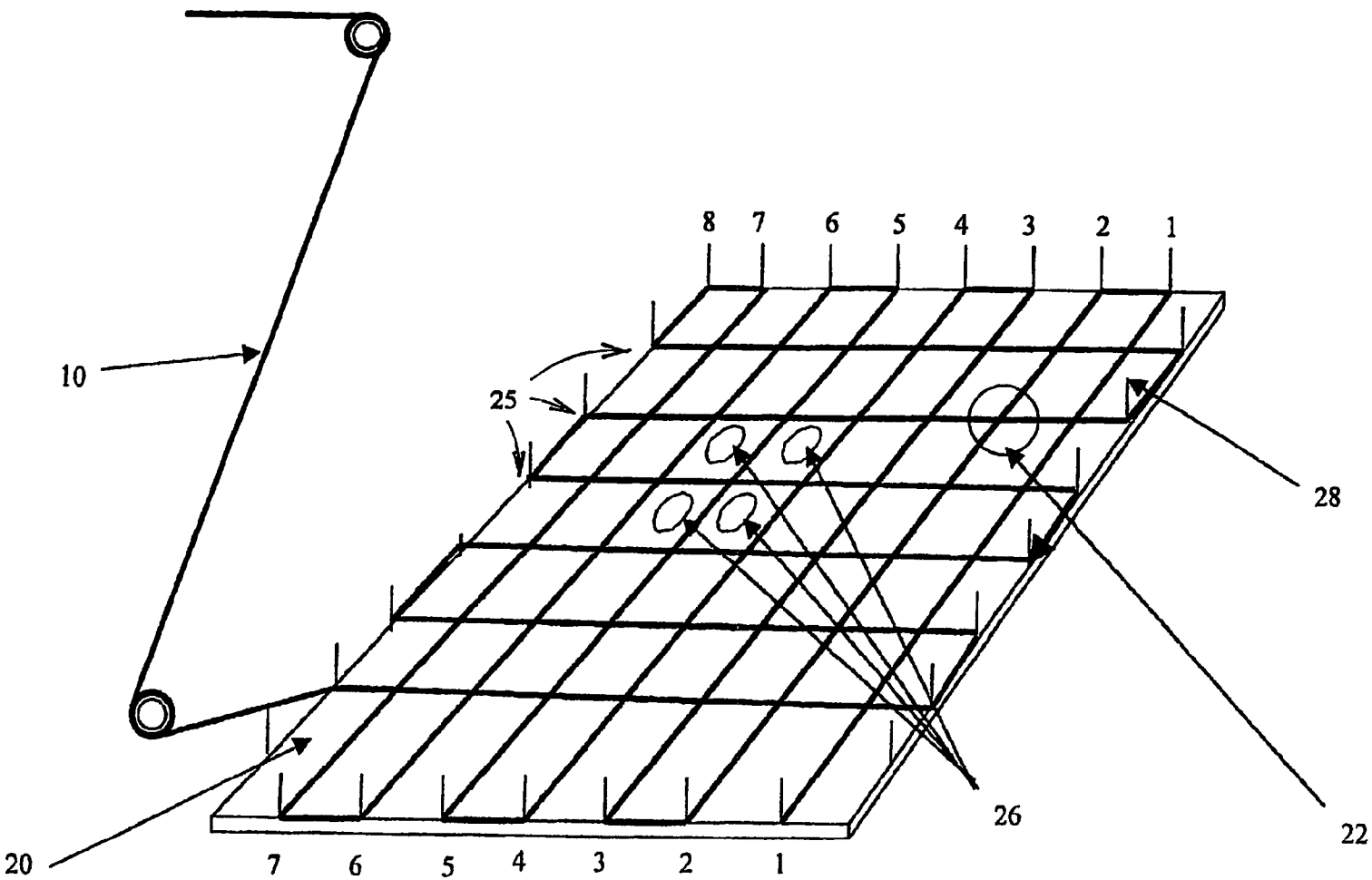
FIG. 6 illustrates schematic the fabrication of a reinforcement net based on the method in accordance to the invention, FIG. 7 show in relation to FIG. 6, a slight simplified fabrication, namely with focus on pole type of reinforcement elements, FIG. 8 show another modified performance from the one in FIG. 6, for fabrication of a reinforcement mesh where the elements are crossing with variable angular, and FIG. 9 show the cross section and elevated construction of crossing point of a reinforcement mesh from FIG. 6, possibly also FIG. 8.

The completed reinforcement grid is on FIG. 6 as a whole identified 28.

While the impregnation material still is sticky, it is then supplied with particle shaped material as indicated by 25, with other words preferable from above by suitable sprinkling or equal, so that this material can adhere to the fibre bundle over all and simultaneously be collected at the supporting surface 20. The collection of the particle shaped material on this surface can possibly take place to such a thickness or height that the surface touches the fibre bundle in the reinforcement grid 28 resulting in a more intimate contact and adhesion. This collection of the particles can also be performed in advance prior to location of the fibre bundle, especially for good cover on the lower side of the fibre bundles.

After such a covering of the fibre bundle(s) they remain strapped until curing of the plastic material has taken place. This can for example take place by providing heat in an appropriate manner. Thereby the particle material get fixated to the surface of the fibre bundles as explained in connection to FIGS. 2 and 3 above.

Prior to or after removing the finished coated reinforcement mesh 20, from the guiding elements on the supporting surface 20, it can be convenient to remove the sand or particle material, by advantage this can take place by openings 26 in the supporting surface 20. At this location, 4 positions 26 is shown, however in practices a larger number can be beneficial, as potentially can be closable. Suitable remedy for such removal of leftover particle material can be taken into action.

Figure 9:
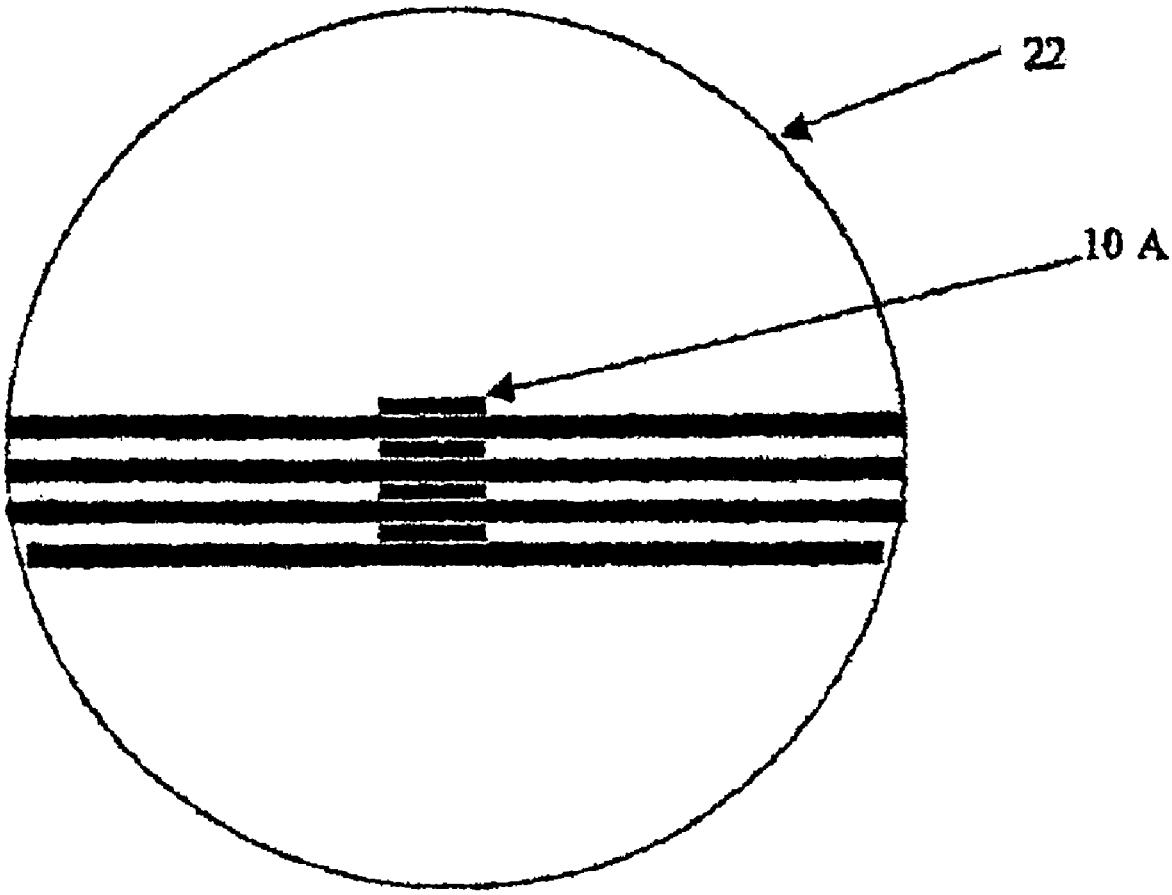

On FIG. 6 a crossing point 22 is marked in the reinforcement mesh, and a great enlargement such crossing point 22 is shown in the cross section on FIG. 9. In the crossing layer of the fibre bundles there the upper cross section of the fibre bundle 10A is shown, as mainly is a band shape with a certain plain pressure, rectangular cross section profile. Under the fibre bundle 10A it is also shown altering crossing fibre bundles totally eight layers in this shown example for a crossing point 22. The connection in the crossing point will in this way be very powerful, in high degree because of the impregnation and the following curing. Further more, it is of impotence in this connection that provided particle shaped material or sand (at position 25 on FIG. 6) not will have the tendency to penetrate in between the layers in the crossing point 22. Consequently it is also here avoided that destructive pollutions or sharp particles can enter inn and harm the fibres in the crossing points.

Figure 8:
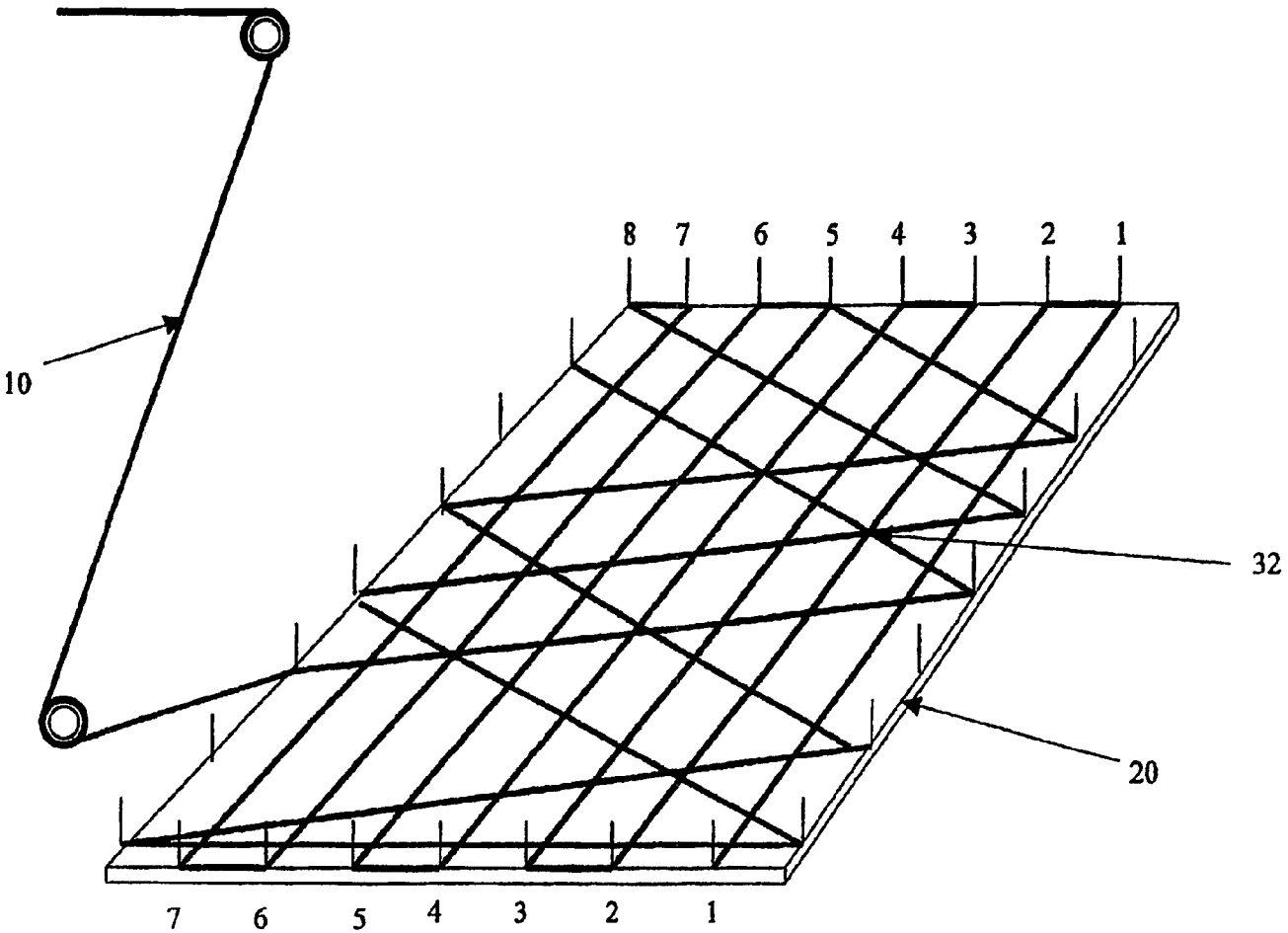

Now it refer to FIG. 8 as show a modification of the mesh pattern in accordance to FIG. 6, namely by that the provided fibre bundle 10 is guided in a more or less irregular and diagonal angular to creation of a reinforcement mesh with variations of the mesh geometry, namely basically a non rectangular mesh.

This can be advantages for some applications. Also here it is pin pointed at a crossing point, namely as indicated at 32, where the layer construction can take place totally analogue with that illustrated on FIG. 9.

Figure 7:
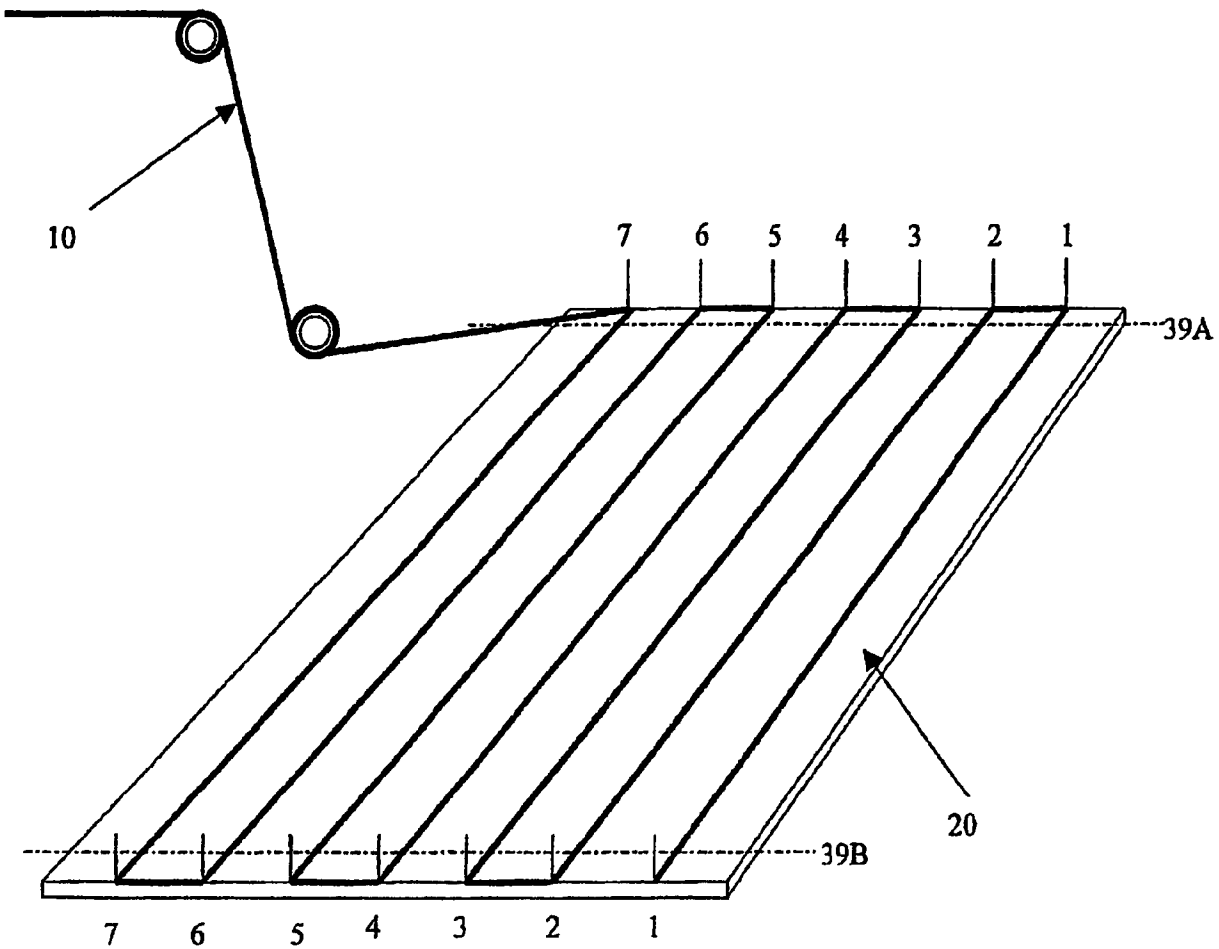

Finally FIG. 7 show a utilization of the supporting surface 20 including guiding elements 1-7 for fabrication of straight length reinforcement elements, namely with lengths close to the length between edge of the surface 20 supplied with the guidance elements 1-7. After completed winding as the situation is described on FIG. 7, with the following applying of the particle formed material followed by curing, each individual straight length reinforcement element cut loose by cutting along line 39A and 39B as indicated on FIG. 7. This execution can be taken as an alternative to the more continues fabrication in accordance to the illustration on FIG. 2. A modification of the method in accordance to FIG. 7 can be to neglect to cut the elements, by that the whole structure is lifted up from the supporting surface and is bended or straight out to create of a longer, continues reinforcing element.

Considering providing with particle formed material, further alternatives than described above are present. Another alternative is to guide the fibre bundle threw a cyclone or equal where it maintain a swirl or "sky" of air and sand or other particle material.

It can be realized based on the description above that until curing of the impregnation or matrix material takes place, can the fibre bundles, or reinforcement elements, eventually the reinforcement grid or structure in three dimensions, be given near all different shapes from the simple straight poles or bands to more complicated configurations as described. In all cases it will be achieved a very favourable geometry for reinforcement elements wile embedded in concrete gives very good adhesion or anchoring as wanted. This get achieved in spite of very low investments in fabrication equipment and with limited need for energy consumption heating.

The invention claimed is:

1. Method for fabrication of a reinforcement element (19, 28) for concrete, comprising:

a bundling step of bundling on the order of at least 1,000 single, continuous fibers into a fiber bundle (10);

an impregnation step of passing the thus-formed fiber bundle through a bath containing a liquid plastic-based matrix for impregnation to form a non-cured, wet fiber bundle;

an adhering step, after said impregnation (3) step and prior to any curing (17), of pulling the non-cured, wet fiber bundle through a reservoir of particle-shaped material in a particle-shaped material bath so that the wet fiber bundle is brought to cooperate with the particle-shaped material (15,25) by pulling up the wet fiber bundle through a hole (13) in a bottom of a container (12) containing the particle-shaped material (15), which particle-shaped material is adhered to the surface of the wet fiber bundle, mainly without coming in between the single fibers, to form a particle adhered fiber bundle with the particle-shaped material adhered on the surface; and a curing step of curing the particle-shaped material adhered on the surface of the fiber bundle so the particle-shaped material are fixed to the surface by the curing, for creation of a reinforcement element (19,28).

2. Method according to claim 1, wherein, said adhering step includes giving the wet fiber bundle a required cross-sectional shape, the hole has a shape corresponding to the required cross-sectional shape of the fiber bundle, and the required cross-sectional shape of the fiber bundle (10) is obtained during said adhering step by pulling up the wet fiber bundle through the correspondingly shaped hole (13).

3. Method according to claim 2, comprising the further step, after said adhering step, wherein the fiber bundle (10) is pulled from the container (12) by being wound up around a rotating mould body (29), the cross-sectional shape of which mould body is adapted to give a desired final exterior configuration to the reinforcement element.

4. The method of claim 1, wherein, the particle-shaped material is sand ranging in particle diameter from 100 microns to 5,000 microns.

5. The method of claim 1, wherein carbon fibers are used as the single fibers.

6. The method of claim 1, wherein, pulling said wet fiber bundle through said hole gives the reinforcement element an overall circular or oval cross section.

7. Method for fabrication of a reinforcement element (19, 28) for concrete, comprising the sequential steps of:

pulling at least 1,000 single, continuous fibers from fiber spools and gathering the pulled fibers into a fiber bundle (10);

impregnating the fiber bundle with a liquid matrix by lowering the fiber bundle in into a bath containing the liquid matrix thereby forming a non-cured, wet fiber bundle impregnated with the matrix;

pulling the wet fiber bundle upward out of the bath with a first pulling device;

using a second pulling device, pulling the wet fiber bundle vertically upward through a nozzle (13) located in a bottom of container (12) holding a particle bath, the particle bath comprising a reservoir of particles, so that a cross-section of the wet bundle is shaped by a cross-sectional shape of the nozzle during the pulling up of the wet bundle upward through the nozzle and the particles of the particle bath are adhered to an exterior surface of the wet fiber bundle to form a particle-adhered, cross-section shaped fiber bundle; and curing the shaped fiber bundle.

8. The method of claim 7, wherein, the curing step is performed at a temperature in a range of 15 through 40° C. so the particles are fixed to the exterior surface by the curing to create a reinforcement element (19,28) having a surface shear capacity with respect to concrete of from 1 to 50 Mpa.

9. The method of claim 8, wherein, each fiber has a diameter of 7 microns.

10. The method of claim 7, wherein, a viscosity of the matrix bath, based on a Brookfield test in accordance to ASTM D 2196-86, is in a range of 100-1000 mPas(cP).

11. The method of claim 7, wherein, the first pulling device is a pair of rollers and the fiber bundle passes between the rollers, the second pulling device is a pair of rollers and the fiber bundle passes between the rollers, and the particles have a diameter in a range of 100 microns to 5000 microns.

12. The method of claim 7, further comprising:

prior to the curing step, a further step of coiling the shaped fiber bundle around a mold body, and the mold body has a cross-section of one of a triangular shape, a hexagonal shape, and an octagonal shape.

13. The method of claim 7, further comprising:

prior to the curing step, a further step of wrapping the shaped fiber bundle around guiding elements extending upward from a horizontal support to form a reinforced element mesh.

14. Method for fabrication of a reinforcement element (19,28) for concrete, comprising the sequential steps of:

impregnating a fiber bundle (10) with a liquid matrix to form a matrix-impregnated, wet fiber bundle, the wet fiber bundle comprising at least 1,000 single, continuous fibers impregnated with the matrix;

giving the wet fiber bundle a required cross-section profile by changing a cross-section of the wet fiber bundle to the required cross-section and applying a particle material to an exterior surface of the wet fiber bundle by i) pulling the wet fiber bundle through a nozzle (13) located in a bottom of a container (12) holding a material bath containing the particle material so that a cross section of the nozzle gives the pulled wet fiber bundle the required cross-section profile by passing through the nozzle (13) and adopting the cross-section shape of the nozzle and ii) upon entering the material bath, the wet bundle being brought to cooperate with the particle material (15,25) contained within the material bath, the particle material adhering to the exterior surface of the wet fiber bundle to form a particle-adhered shaped fiber bundle; and curing the particle material adhered on the surface of the shaped fiber bundle.

15. The method of claim 14, wherein, the curing step is performed at a temperature in a range of 15 through 40° C. so the particles are fixed to the exterior surface by the curing to create a reinforcement element (19,28) having a surface shear capacity with respect to concrete of from 1 to 50 Mpa.

16. The method of claim 14, wherein, a viscosity of the matrix bath, based on a Brookfield test in accordance to ASTM D 2196-86, is in a range of 100-1000 mPas(cP), and particles of the particle material have a diameter in a range of 100 microns to 5000 microns.

17. The method of claim 14, further comprising:

prior to the curing step, a further step of coiling the shaped fiber bundle around a mold body, and the mold body has a cross-section of one of a triangular shape, a hexagonal shape, and an octagonal shape.

18. The method of claim 14, further comprising:

prior to the curing step, a further step of wrapping the shaped fiber bundle around guiding elements extending upward from a horizontal support to form a reinforced element mesh.

* * * * *